US010128069B1

(12) United States Patent
Ruempler et al.

(10) Patent No.: US 10,128,069 B1
(45) Date of Patent: Nov. 13, 2018

(54) ELECTRICAL SWITCHING APPARATUS AND DEBRIS BARRIER THEREFOR

(71) Applicant: EATON CORPORATION, Cleveland, OH (US)

(72) Inventors: Christian Ruempler, Wexford, PA (US); Brian John Schaltenbrand, Pittsburgh, PA (US); Andrew Lawrence Gottschalk, Monaca, PA (US); Richard Paul Malingowski, McDonald, PA (US); Kelly Julia McCarthy, Moon Township, PA (US); Xin Zhou, Wexford, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/652,619

(22) Filed: Jul. 18, 2017

(51) Int. Cl.
*H01H 33/08* (2006.01)

(52) U.S. Cl.
CPC ..... *H01H 33/08* (2013.01)

(58) Field of Classification Search
CPC H01H 9/34; H01H 9/36; H01H 9/346; H01H 33/08; H01H 71/46; H01H 71/0235; H01H 2235/004; H01H 9/44
USPC ..... 218/149, 156, 15, 34, 41, 46, 81, 38
See application file for complete search history.

(56) References Cited

U.S. PATENT DOCUMENTS 2,244,061 A * 6/1941 Graves, Jr. ..... H01H 9/362 218/149
6,248,970 B1 * 6/2001 DiMarco ..... H01H 9/34 218/149
6,281,459 B1 8/2001 Munsch et al.
6,518,530 B2 * 2/2003 Heins ..... H01H 9/362 218/38
6,825,431 B2 * 11/2004 Azzola ..... H01H 9/362 218/156
6,831,536 B1 12/2004 Lindler
6,970,059 B2 11/2005 Meuller et al.
7,186,941 B2 * 3/2007 Yeon ..... H01H 9/302 218/38
7,348,514 B2 3/2008 Puskar et al.
7,358,840 B1 4/2008 Shea
7,532,097 B2 5/2009 Malingowski et al.
8,222,983 B2 7/2012 Zhou et al.
8,237,074 B2 * 8/2012 Tetik ..... H01H 9/362 218/34
8,368,492 B1 2/2013 Theisen et al.
(Continued)

*Primary Examiner* — Renee S Luebke
*Assistant Examiner* — William Bolton
(74) *Attorney, Agent, or Firm* — Eckert Seamans

(57) ABSTRACT

A debris barrier is for an electrical switching apparatus. The electrical switching apparatus includes separable contacts and an arc chute. The separable contacts generate debris when tripping open in response to an electrical fault. The arc chute has a plurality of splitter plates each having an edge portion and a distal portion located opposite and distal the edge portion. The debris barrier includes a first leg, a second leg, and a middle portion connecting the first leg and the second leg. The middle portion is coupled to one of the separable contacts. At least one of the first leg and the second leg has a first barrier portion and a second barrier portion extending therefrom. The first barrier portion is located proximate the distal portion. The second barrier portion extends from the first barrier portion toward the edge portion in order to redirect the debris toward the edge portion.

16 Claims, 9 Drawing Sheets

(56) References Cited

U.S. PATENT DOCUMENTS

| | | | | |
|---|---|---|---|---|
| 9,006,601 | B2 | 4/2015 | Zhou et al. | |
| 9,396,890 | B2 * | 7/2016 | Smeltzer | H01H 9/34 |
| 9,653,237 | B1 | 5/2017 | Zhou et al. | |

* cited by examiner

ELECTRICAL SWITCHING APPARATUS AND DEBRIS BARRIER THEREFOR

BACKGROUND

Field

The disclosed concept relates generally to electrical switching apparatus and, more particularly, to electrical switching apparatus, such as circuit breakers. The disclosed concept also relates to debris barriers for electrical switching apparatus.

Background Information

Electrical switching apparatus, such as circuit breakers, are employed in diverse capacities in power distribution systems. A circuit breaker may include, for example, a line conductor, a load conductor, a fixed contact and a movable contact, with the movable contact being movable into and out of electrically conductive engagement with the fixed contact. This switches the circuit breaker between an ON or closed position and an OFF or open position, or between the ON or closed position and a tripped or tripped OFF position. The fixed contact is electrically conductively engaged with one of the line and load conductors, and the movable contact is electrically conductively engaged with the other of the line and load conductors. The circuit breaker may also include an operating mechanism having a movable contact arm upon which the movable contact is disposed.

Upon initial separation of the movable contact away from the stationary contact, an electrical arc is formed in the space between the contacts. The arc provides a means for smoothly transitioning from a closed circuit to an open circuit, but produces a number of challenges to the circuit breaker designer. Therefore, it is desirable to extinguish any such arcs as soon as possible upon their propagation. To facilitate this process, circuit breakers typically include arc chutes which are structured to break-up the arcs. Each arc chute includes a plurality of spaced apart arc plates. As the movable contact is moved away from the stationary contact, the movable contact moves past the ends of the arc plates, with the arc being drawn toward and between the arc plates. The arc plates are electrically insulated from one another such that the arc is either split into multiple short arcs or squeezed into and extinguished by the arc plates.

Arcs, which extend between the electrical contacts, often result in metal material (e.g., without limitation, metal material of the electrical contacts or the movable arm) melting and being vaporized. This metal material creates debris, which can undesirably accumulate in critical functional areas of the circuit breaker and cause the circuit breaker to malfunction.

There is, therefore, room for improvement in electrical switching apparatus and in debris barriers therefor.

SUMMARY

These needs and others are met by embodiments of the disclosed concept, which are directed to an electrical switching apparatus and debris barrier therefor.

As one aspect of the disclosed concept, a debris barrier is provided for an electrical switching apparatus. The electrical switching apparatus includes a pair of separable contacts and an arc interruption system having an arc chute located at or about the pair of separable contacts in order to not only extinguish the arc, but also attract and dissipate debris generated by the arc erosion while the pair of separable contacts trip open in response to an electrical fault. The arc chute includes a plurality of splitter plates each having an edge portion and at least one distal portion located opposite and distal the edge portion. The debris barrier includes a first leg, a second leg, and a middle portion connecting the first leg and the second leg. The middle portion is structured to be coupled to one of the pair of separable contacts. At least one of the first leg and the second leg has a first barrier portion and a second barrier portion extending from the first barrier portion. The first barrier portion is structured to be located at or about the distal portion. The second barrier portion is structured to extend from the first barrier portion toward the edge portion in order to redirect the debris toward the edge portion.

As another aspect of the disclosed concept, an electrical switching apparatus including a pair of separable contacts, an arc interruption system, and the aforementioned debris barrier is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the terms "generally U-shaped" or "generally U-shape" or "general U-shape" shall mean that the shape of a corresponding structure has the general shape of the letter "U" in which the bottom of such letter or structure is rounded, generally round, square, generally square, or partially round and partially square, or has the general shape of a base member with two leg (or arm) members extending normal or generally normal from the ends of the base member.

EXAMPLE 1

Figure 1:
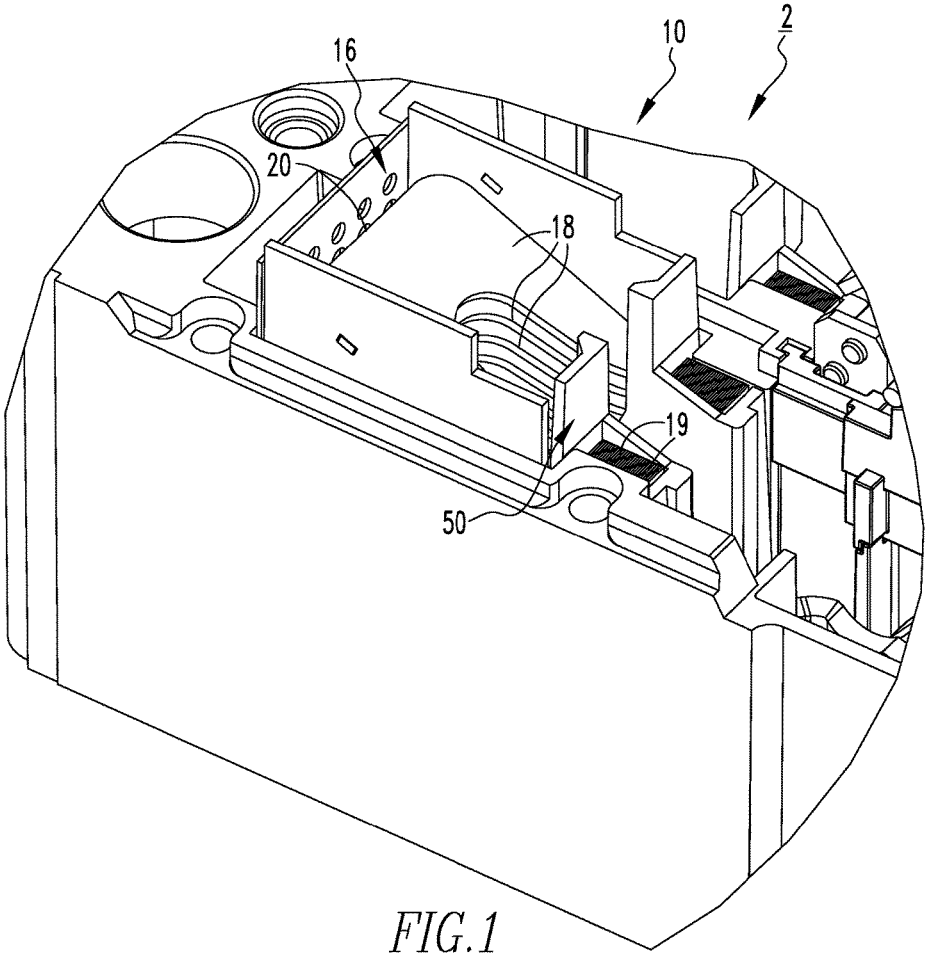
FIG. 1 is an isometric view of a portion of an electrical switching apparatus and debris barrier therefor, in accordance with a non-limiting embodiment of the disclosed concept.
Figure 2:
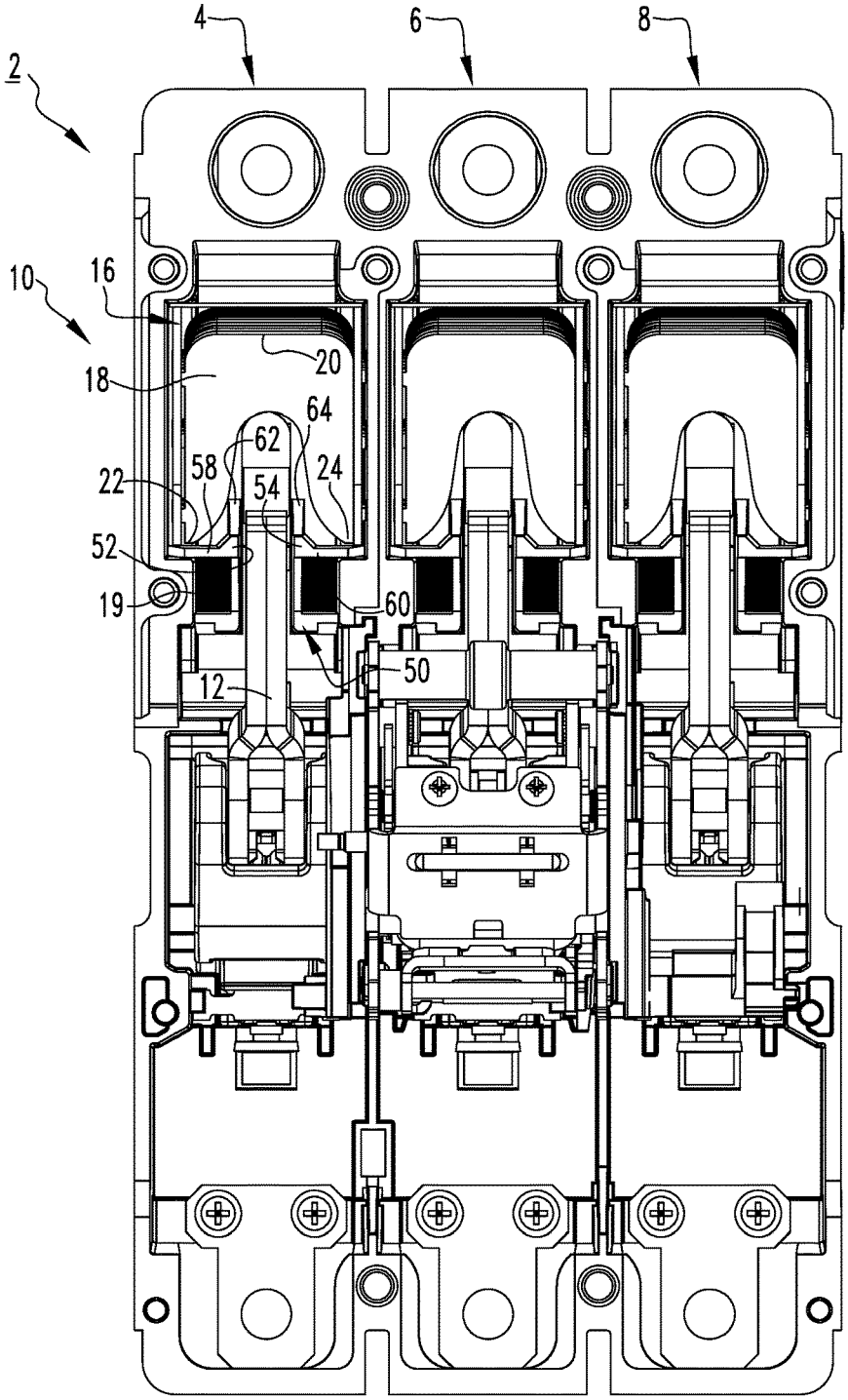
FIG. 2 is a top plan view of the electrical switching apparatus and debris barrier therefor of FIG. 1.
Figure 3:
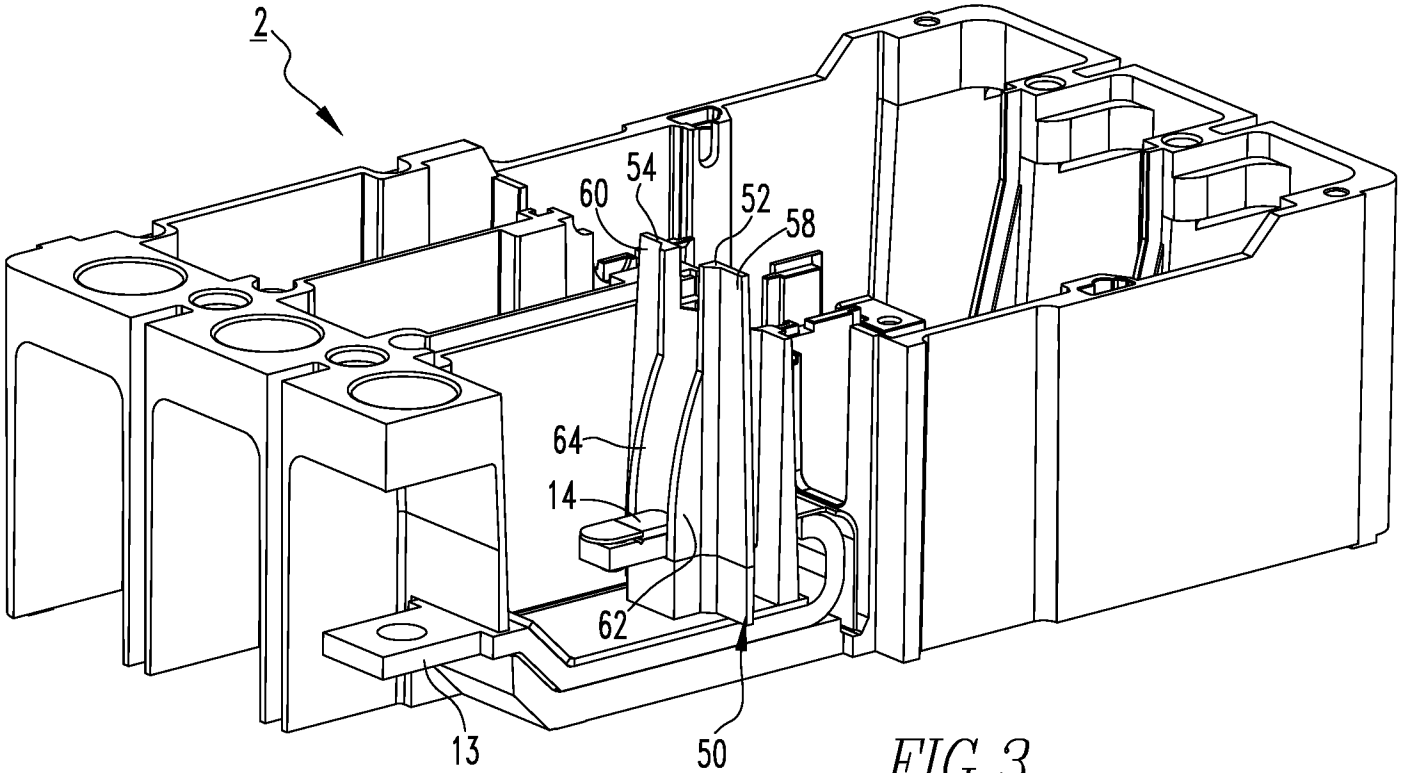
FIG. 3 is an isometric view of another portion of the electrical switching apparatus of FIG. 1, shown with certain components removed to show hidden features of the debris barrier.
Figure 4:
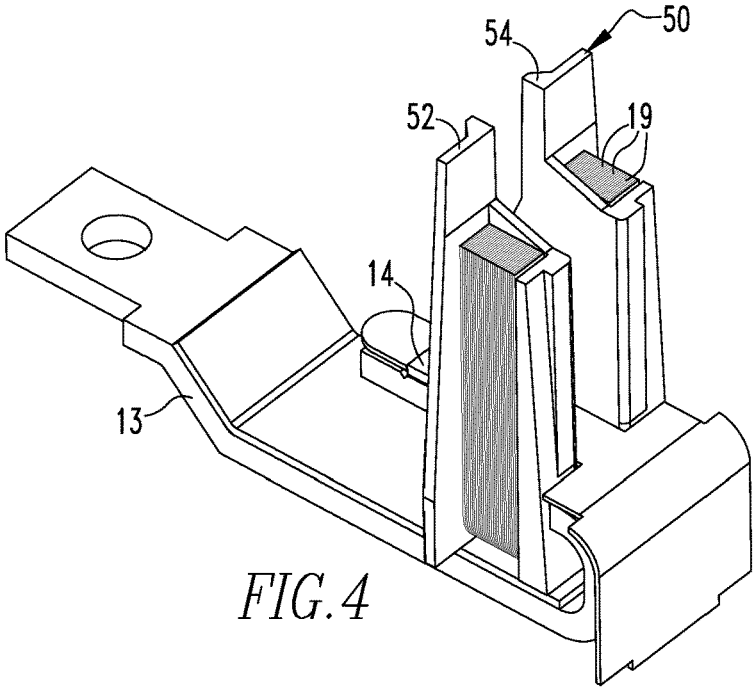
FIG. 4 is an isometric view of the debris barrier of FIG. 3, also showing a line conductor and a number of laminations of the electrical switching apparatus.
Figure 5:
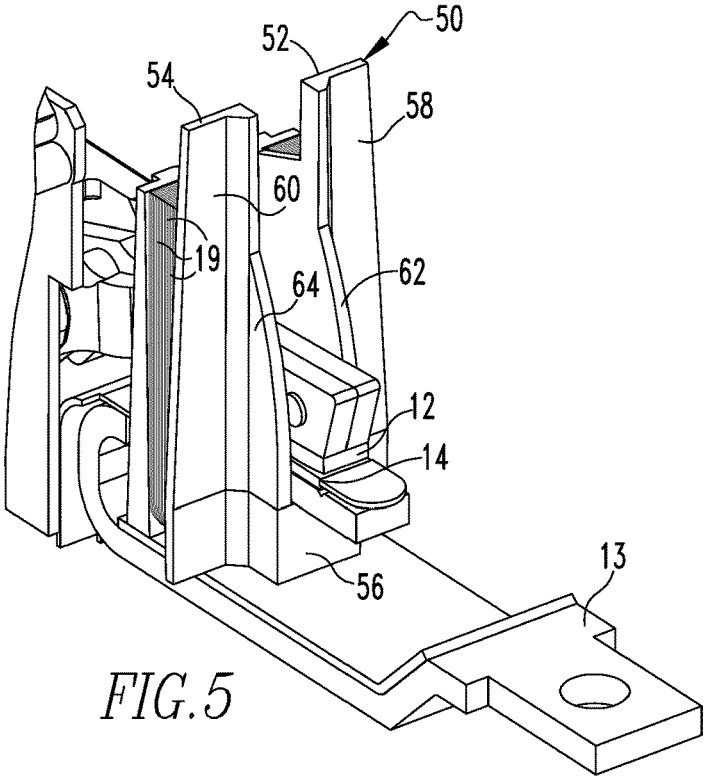
FIG. 5 is another isometric view of the debris barrier, line conductor, and laminations of FIG. 4, also showing a movable contact of the electrical switching apparatus.

FIGS. 1-3 depict different views of an electrical switching apparatus (e.g., without limitation, multi-pole circuit breaker 2), in accordance with one non- limiting embodiment of the disclosed concept. The example circuit breaker 2 has a plurality of poles 4,6,8, as shown in FIG. 2. However, for ease of illustration and economy of disclosure, only pole 4 will be discussed in detail, although it will be appreciated that poles 6,8 are configured substantially the same as pole 4. Pole 4 has an arc interruption system 10, a movable contact (see, for example, movable contact 12, shown in FIGS. 2 and 5), and a line conductor 13 (FIGS. 3-5) having a stationary contact 14 (FIGS. 3-5). The movable contact 12 is structured to move into and out of engagement with the stationary contact 14 in a generally well known manner in order to close and open an electrical circuit, respectively. Furthermore, the separable contacts 12,14 are structured to generate debris when tripping open in response to an electrical fault. In one example embodiment, the arc interruption system 10 includes an arc chute 16 and a slot motor (e.g., a number of generally U-shaped ferromagnetic laminations 19). The arc chute 16 is located at or about the separable contacts 12,14 and functions to cool and split an arc that is generated by the separable contacts 12,14 tripping open in response to an electrical fault. The laminations 19 advantageously assist with accelerating the movable contact 12 during opening, thereby improving the interruption performance by reducing arcing energies.

The arc chute 16 has a plurality of splitter plates 18 each having an edge portion 20 and at least one distal portion 22,24 (FIG. 2) located opposite and distal the edge portion 20. The edge portion 20 is located at a rear portion of the arc chute 16, for example, opposite and distal the separable contacts 12,14 such that the movable contact 12 moves in a plane perpendicular to the edge portion 20. Additionally, although the disclosed concept is being described herein in association with each of the splitter plates 18 including two opposing distal portions 22,24, it is within the scope of the disclosed concept for a suitable alternative arc chute (not shown) to employ splitter plates having only one distal portion opposite an edge portion. Furthermore, as will be discussed in greater detail below, the circuit breaker 2 includes a novel debris barrier 50 that redirects debris generated from tripping open of the separable contacts 12,14. This protects critical functional areas of the circuit breaker 2, thereby minimizing the likelihood that the circuit breaker 2 will malfunction from debris accumulation.

Figure 8:
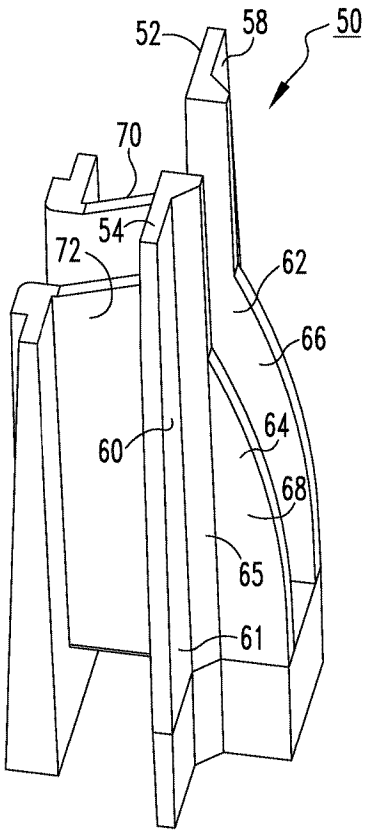
FIGS. 6, 7 and 8 are various isometric views of the debris barrier of FIG. 5.
Figure 7:
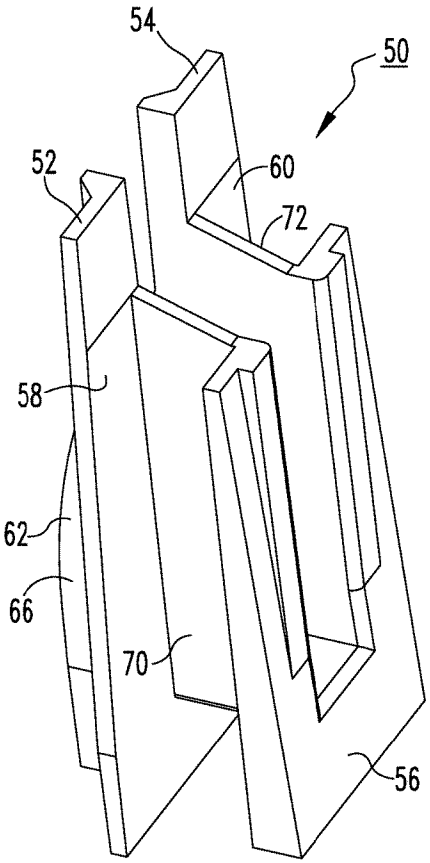
Figure 6:
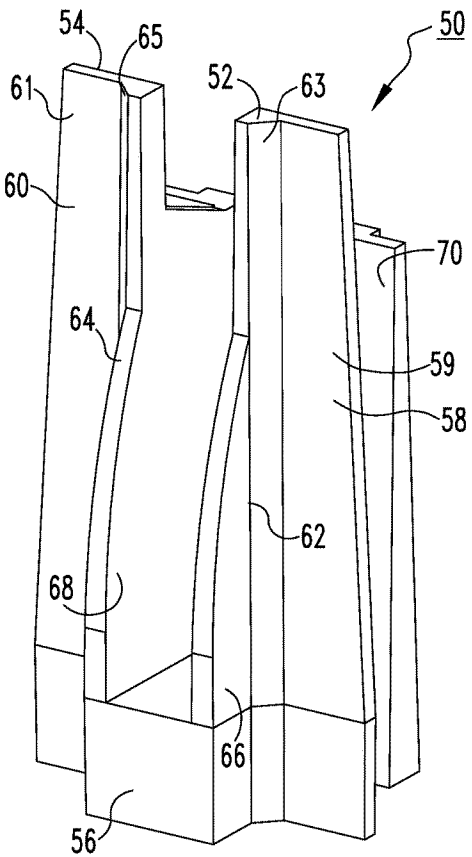

FIGS. 6-8 show different views of the debris barrier 50. In one example embodiment, the debris barrier 50 is a unitary component made from a single piece of thermoset material. By being made of a thermoset material, the debris barrier 50 can better withstand arcing (e.g., is less likely to melt under tough arcing loads), as compared to a similarly structured thermoplastic debris barrier. Additionally, certain regulations (e.g., without limitation, regulations in the nuclear industry) prohibit the use of thermoplastic materials. Furthermore, by being a unitary component, manufacture of the debris barrier 50 is advantageously relatively simple in that no separate assembly steps are required. It will, however, be appreciated that a suitable alternative debris barrier may be made of multiple components that are separately assembled together, and/or may be made from other materials (e.g., without limitation, thermoplastics), without departing from the scope of the disclosed concept. As shown, the debris barrier 50 is generally U-shaped and includes a first leg 52, a second leg 54, and a middle portion 56 connecting the first leg 52 to the second leg 54. Referring to FIGS. 4 and 5, the middle portion 56 is preferably coupled to and reliably maintained on the stationary contact 14. Accordingly, it will be appreciated that the movable contact 12 is structured to move in a plane located between the first and second legs 52,54 (see, for example, FIG. 2, wherein the movable contact 12 is located between the legs 52,54).

As shown in FIGS. 6-8, the legs 52,54 include respective first barrier portions 58,60, respective second barrier portions 62,64 extending from the respective first barrier portions 58,60, and respective pocket portions 70,72 extending from the respective first barrier portions 58,60 away from the respective second barrier portions 62,64. The pocket portions 70,72 are a number of walls that are cooperatively structured to receive the laminations 19 (FIGS. 1, 2, 4, and 5). As such, the debris barrier 50 advantageously functions to redirect debris, as will be discussed below, and further to house and maintain the laminations 19. The first barrier portions 58,60 include respective barrier surfaces 59,61 that face away from the respective pocket portions 70,72. The second barrier portions 62,64 have respective barrier surfaces 63,65 that each extend at obtuse angles from one of the barrier surfaces 59,61 away from the respective pocket portions 70,72. Furthermore, the second barrier portions 62,64 have extension portions 66,68 extending from the respective barrier surfaces 63,65 and being located generally perpendicular to the respective first barrier portions 58,60.

The novel functionality of the barrier member 50 will now be discussed in greater detail. As shown in FIG. 2, the first barrier portions 58,60 are located at or about the distal portions 22,24 of the splitter plates 18. In one example embodiment, the distal portions 22,24 engage the first barrier portions 58,60. Furthermore, as shown, the second barrier portions 62,64 extend from the first barrier portions 58,60 toward the edge portion 20. Accordingly, the second barrier portions 62,64 are located between the first distal portion 22 and the second distal portion 24. Stated differently, the second barrier portions 62,64, which are the portions of the debris barrier 50 extending away from the laminations 19, overlap a portion of the splitter plates 18 and/or extend into an interior of the arc chute 16. That is, the second barrier portions 62,64 protrude outwardly from the first barrier portions 58,60 away from the laminations 19 and past the distal portions 22,24. In other words, the second barrier portions 62,64 are located substantially closer to the edge portion 20 than the distal portions 22,24. This is distinct from prior art housings of slot motors (e.g., U-shaped ferromagnetic laminations) in which the distalmost portions of the housings are located at (e.g., not past) distal portions of splitter plates. It will be appreciated that the aforementioned geometry of the barrier member 50, and its placement in the circuit breaker 2 with respect to the splitter plates 18, advantageously redirects debris generated by the separable contacts 12,14 tripping open toward the edge portion 20 and away from critical functional areas of the circuit breaker 2.

Figure 9:
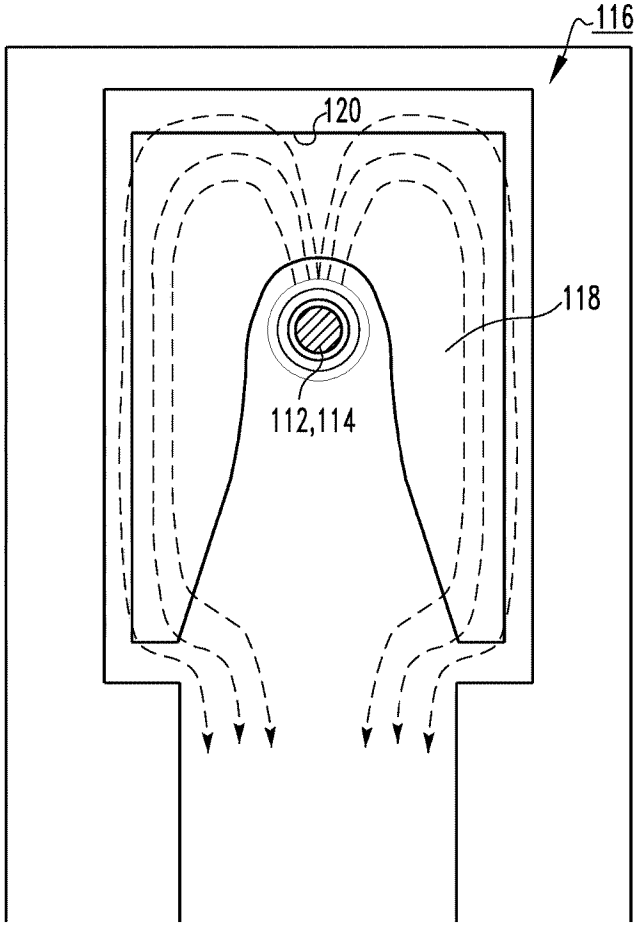
FIG.9 PRIOR ART
FIG. 9 is a simplified plan view of a conventional arc chute, without a debris barrier.

To illustrate, reference will be made to FIGS. 9 and 10, which show simplified plan views of a conventional arc chute 116, and the arc chute 16 of the disclosed concept which is employed with the debris barrier 50, respectively. As shown in FIG. 9, wherein no debris barrier is employed with the conventional arc chute 116, debris, which is represented by dashed lines/arrows, is free to move from a source (e.g., an arcing region proximate a pair of separable contacts 112,114) away from an edge portion 120 of a splitter plate 118. It will be appreciated that movement of debris along the paths shown by the dashed lines/arrows in FIG. 9 results in undesirable accumulation in critical functional areas of the associated circuit breaker, such as the movable contact arm, operating mechanism, cross bar, and trip unit. As stated above, this debris accumulation by employing the conventional arc chute 116 without a debris barrier could cause the associated circuit breaker to malfunction.

Figure 10:
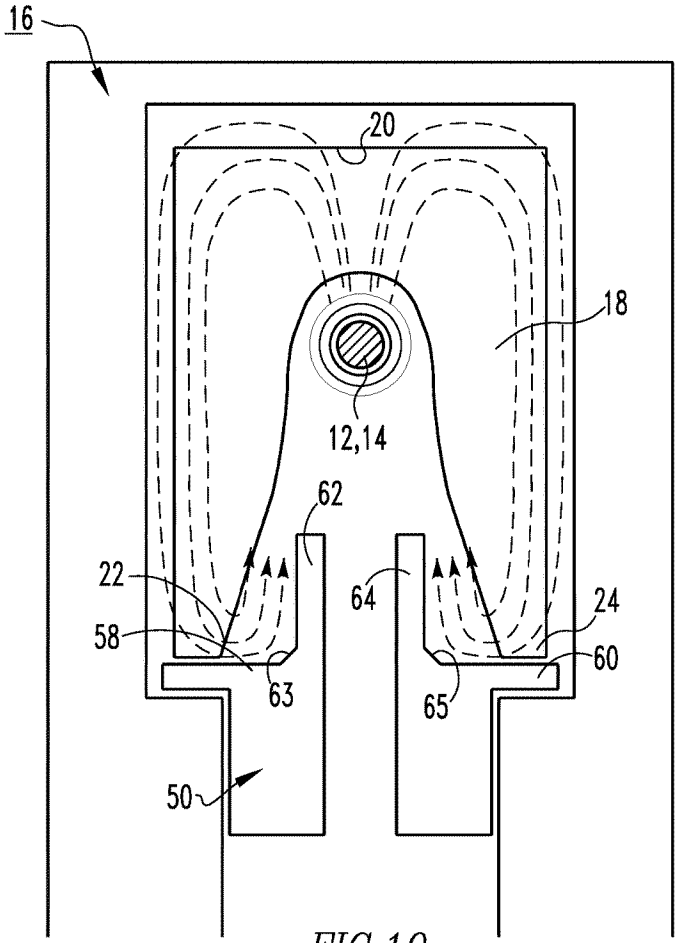
FIG. 10 is a simplified plan view of an arc chute employing a debris barrier in accordance with a non-limiting embodiment of the disclosed concept.

By way of contrast, as shown in the simplified top plan view of FIG. 10, employing the debris barrier 50 with the arc chute 16 of the instant disclosed concept results in a redirection of debris away from the critical functional areas and back toward the edge portion 20. More specifically, after the debris is generated by the arc erosion of surrounding materials while the separable contacts 12,14 trip open, the debris is moved toward the edge portion 20 and then away from the edge portion 20 by walls of the arc chute 16. However, rather than continuing to travel away from the edge portion 20, the first barrier portions 58,60 and the second barrier portions 62,64 cooperatively function to redirect the debris back toward the edge portion 20. Furthermore, the obtuse angles with which the barrier surfaces 63,65 extend from the first barrier portions 58,60 further aide with redirecting debris. Accordingly, the likelihood that debris will accumulate on critical functional areas of the circuit breaker 2 is significantly minimized, advantageously prolonging the life of the circuit breaker 2 and minimizing the possibility of a resulting malfunction.

EXAMPLE 2

Figure 11:
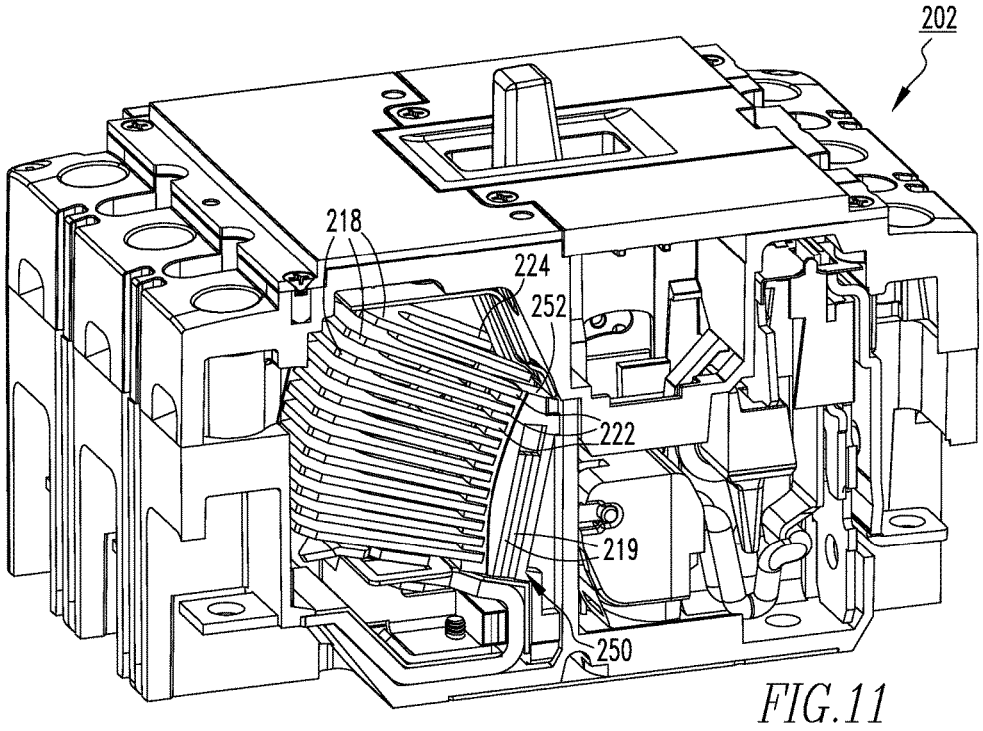
FIG. 11 is an isometric view of an electrical switching apparatus and debris barrier therefor, in accordance with another non-limiting embodiment of the disclosed concept.
Figure 12:
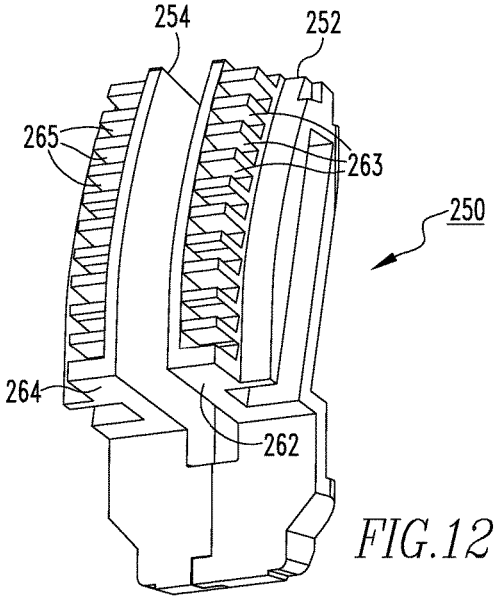
FIG. 12 is an isometric view of the debris barrier of FIG. 11.

FIG. 11 shows another example electrical switching apparatus (e.g., without limitation, multi-pole circuit breaker 202), in accordance with another non-limiting embodiment of the disclosed concept. The example circuit breaker 202 includes a novel debris barrier 250, which is also shown in FIG. 12. As shown in FIG. 12, the second barrier portions 262,264 of the legs 252,254 of the debris barrier 250 each include a corresponding plurality of grooved regions 263, 265. It will be appreciated that the grooved regions 263,265 are structured to receive the distal portions 222,224 of the splitter plates 218 (see, for example, FIG. 11). That is, the debris barrier 250, in addition to redirecting debris, further functions to maintain the splitter plates 218 thereon and also prevents the arc from staying there and causing erosion of the arc plate legs. Additionally, as shown in FIG. 11, the debris barrier 250 is also structured to receive the U-shaped ferromagnetic laminations 219.

EXAMPLE 3

Figure 13:
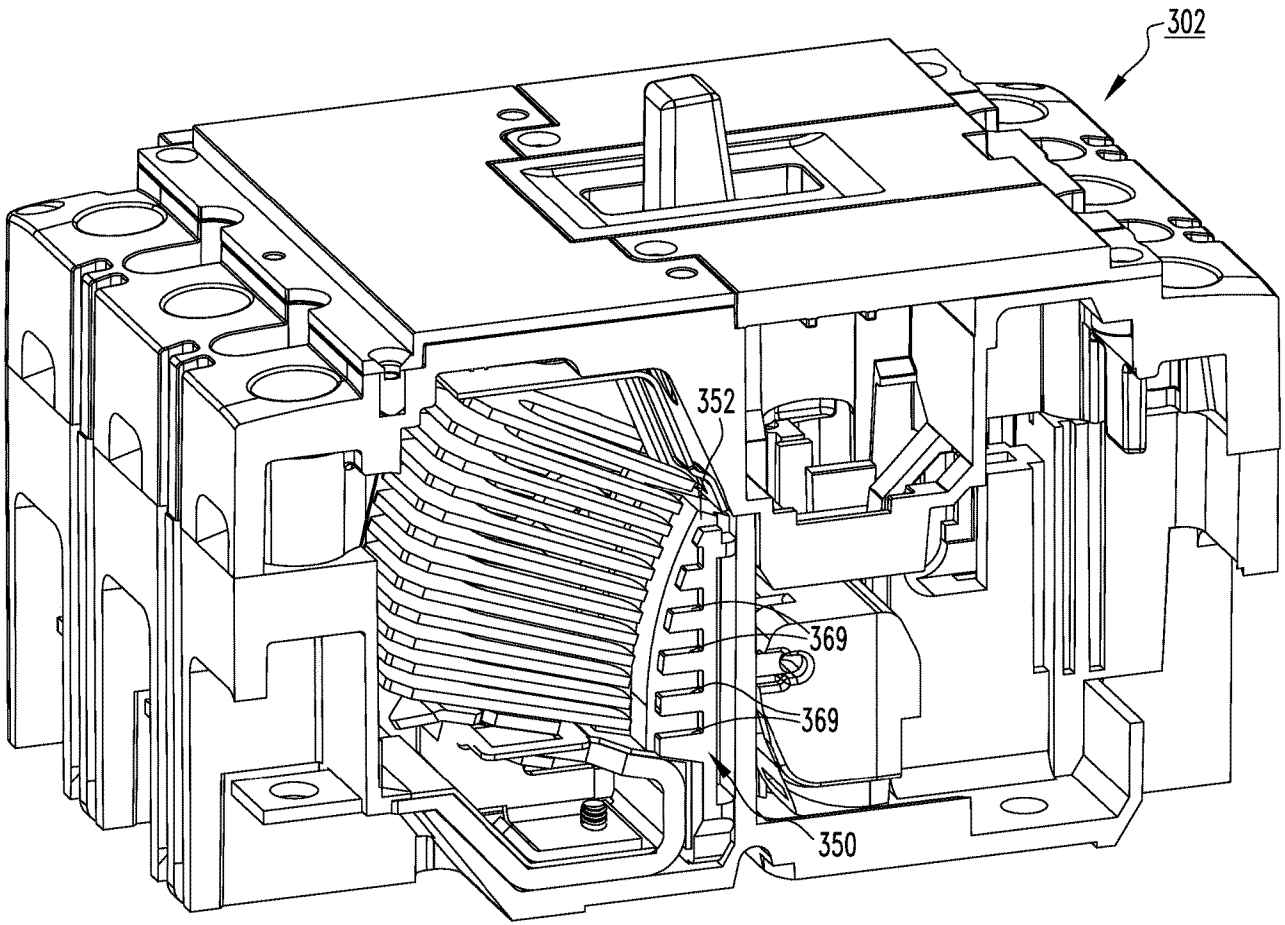
FIG. 13 is an isometric view of an electrical switching apparatus and debris barrier therefor, in accordance with another non-limiting embodiment of the disclosed concept.
Figure 14:
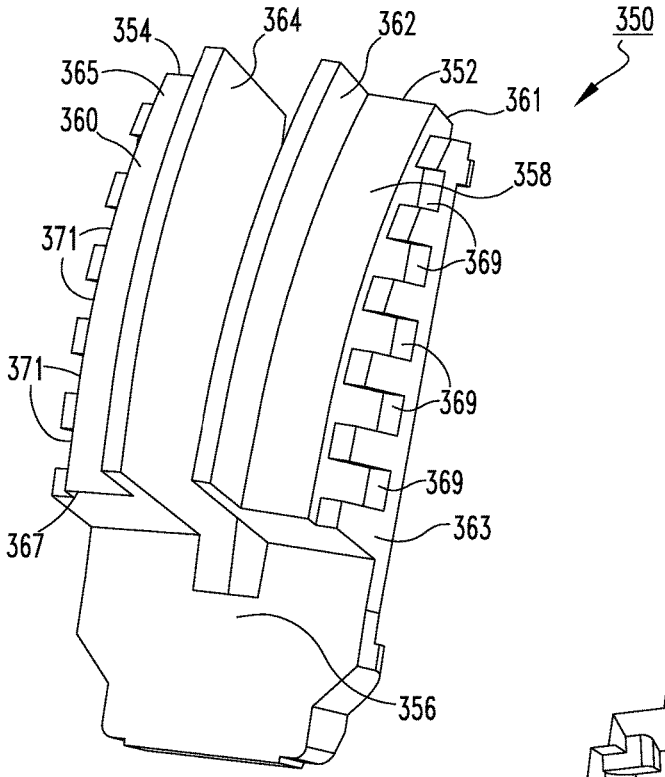
FIGS. 14 and 15 are various isometric views of the debris barrier of FIG. 13.
Figure 15:
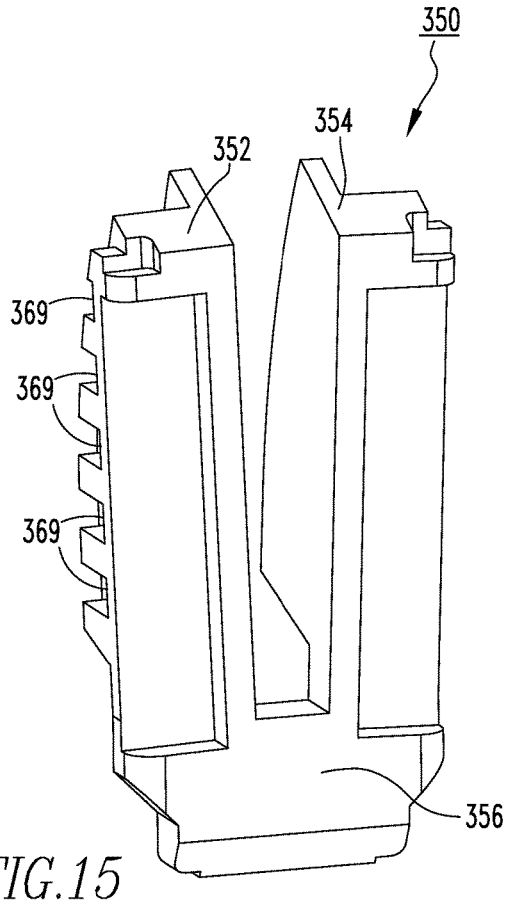

FIG. 13 shows another example electrical switching apparatus (e.g., without limitation, multi-pole circuit breaker 302), in accordance with another non-limiting embodiment of the disclosed concept. The example circuit breaker 302 includes a novel debris barrier 350, which is also shown in FIGS. 14 and 15. As shown in FIGS. 14 and 15, the legs 352,354 of the debris barrier 350 each have a first end 361,365 and a second end 363,367 located opposite and distal the corresponding first end 361,365. The second ends 363,367 are located at the middle portion 356. Furthermore, as shown most clearly in FIG. 14, the first barrier portions 358,360 of the legs 352,354 each have a corresponding plurality of grooved regions 369,371 located at a peripheral portion of the legs 352,354. More specifically, the grooved regions 369,371 extend longitudinally from the corresponding first ends 361,365 to the corresponding second ends 363,367. It will be appreciated that the grooved regions 369,371 advantageously function to provide a reservoir for debris (i.e., debris generated by separable contacts tripping open) to collect. That is, rather than being entirely redirected toward the second barrier portions 362,364, a significant portion of the debris is structured to be caught in the grooved regions 369,371, thereby further protecting critical functional areas of the circuit breaker 302. Moreover, it will be appreciated with reference to FIG. 13 that the distal portions of the splitter plates are spaced from the first barrier portions 358,360. In this manner, debris has a pathway through which to pass, thus minimizing the likelihood that it will get stuck in this region and short out the splitter plates (e.g., an electrical connection of the splitter plates), a situation which would reduce the interruption performance and performance in dielectric testing.

Furthermore, as shown in FIG. 16, the debris barrier 350 is slightly V-shaped. That is, the legs 352,354 are spaced a greater distance from each other proximate a top of the debris barrier 350 than at an opposing bottom of the debris barrier 350. As a result, when the debris barrier 350 is inserted into the circuit breaker 302, the debris barrier 350 will be relatively tightly maintained therein. Additionally, it will be appreciated that the circuit breaker 302 of the disclosed concept is devoid of U-shaped ferromagnetic laminations. That is, the debris barrier 350 in the example of FIGS. 13-15 is not structured to house and maintain U-shaped ferromagnetic laminations.

While the examples of FIGS. 1-8 and 10-15 have been described in association with the debris barriers 50,250,350 having the first barrier portions 58,60,358,360 and the second barrier portions 62,64,262,264,362,364, it will be appreciated that other suitable alternative debris barriers may have barrier portions having different geometries, without departing from the scope of the disclosed concept.

Accordingly, it will be appreciated that the disclosed concept provides for an improved (e.g., without limitation, better protected against malfunction) electrical switching apparatus 2,202,302 and debris barrier 50,250,350 therefor, in which a number of barrier portions 58,60,62,64,262,264, 358,360,362,364 cooperatively function to redirect debris generated by a pair of separable contacts 12,14 tripping open away from critical functional areas of the electrical switching apparatus 2,202,302.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A debris barrier for an electrical switching apparatus, said electrical switching apparatus comprising a pair of separable contacts and an arc interruption system comprising an arc chute disposed at or about said pair of separable contacts, said pair of separable contacts being structured to generate debris when tripping open in response to an electrical fault, said arc chute comprising a plurality of splitter plates each having an edge portion and at least one distal portion disposed opposite and distal said edge portion, said debris barrier comprising:

a first leg;

a second leg; and a middle portion connecting said first leg and said second leg, said middle portion being structured to be coupled to one of said pair of separable contacts, wherein at least one of said first leg and said second leg comprises a first barrier portion and a second barrier portion extending from said first barrier portion, said first barrier portion being structured to be disposed at or about said at least one distal portion, said second barrier portion being structured to extend from said first barrier portion toward said edge portion in order to redirect said debris toward said edge portion; wherein said at least one of said first leg and said second leg comprises both of said first leg and said second leg; wherein said at least one distal portion comprises a first distal portion and a second distal portion disposed opposite and distal said first distal portion; wherein said second barrier portion of said first leg and said second barrier portion of said second leg are each structured to be disposed between said first distal portion and said second distal portion; wherein said second barrier portion of said first leg comprises an extension portion disposed generally perpendicular to said first barrier portion of said first leg; and wherein said second barrier portion of said second leg comprises an extension portion disposed generally perpendicular to said first barrier portion of said second leg.

2. The debris barrier of claim 1 wherein said debris barrier is a unitary component made from a single piece of thermoset material.

3. A debris barrier for an electrical switching apparatus, said electrical switching apparatus comprising a pair of separable contacts and an arc interruption system comprising an arc chute disposed at or about said pair of separable contacts, said pair of separable contacts being structured to generate debris when tripping open in response to an electrical fault, said arc chute comprising a plurality of splitter plates each having an edge portion and at least one distal portion disposed opposite and distal said edge portion, said debris barrier comprising:

a first leg;

a second leg; and a middle portion connecting said first leg and said second leg, said middle portion being structured to be coupled to one of said pair of separable contacts, wherein at least one of said first leg and said second leg comprises a first barrier portion and a second barrier portion extending from said first barrier portion, said first barrier portion being structured to be disposed at or about said at least one distal portion, said second barrier portion being structured to extend from said first barrier portion toward said edge portion in order to redirect said debris toward said edge portion; wherein said at least one of said first leg and said second leg comprises both of said first leg and said second leg; wherein said at least one distal portion comprises a first distal portion and a second distal portion disposed opposite and distal said first distal portion; wherein said second barrier portion of said first leg and said second barrier portion of said second leg are each structured to be disposed between said first distal portion and said second distal portion; wherein said first leg further comprises a first pocket portion extending from said first barrier portion of said first leg away from said second barrier portion of said first leg; wherein said second leg further comprises a second pocket portion extending from said first barrier portion of said second leg away from said second barrier portion of said second leg; wherein said arc interruption system further comprises a number of U-shaped ferromagnetic laminations; and wherein said first pocket portion and said second pocket portion are structured to receive said number of U-shaped ferromagnetic laminations.

4. The debris barrier of claim 3 wherein said second barrier portion of said first leg comprises a plurality of first grooved regions each structured to receive a corresponding first distal portion; and wherein said second barrier portion of said second leg comprises a plurality of second grooved regions each structured to receive a corresponding second distal portion.

5. The debris barrier of claim 3 wherein said first barrier portion of said first leg has a first barrier surface facing away from said first pocket portion; wherein said second barrier portion of said first leg has a second barrier surface extending at an obtuse angle from said first barrier surface away from said first pocket portion; wherein said first barrier portion of said second leg has a third barrier surface facing away from said second pocket portion; and wherein said second barrier portion of said second leg has a fourth barrier surface extending at an obtuse angle from said third barrier surface away from said second pocket portion.

6. A debris barrier for an electrical switching apparatus, said electrical switching apparatus comprising a pair of separable contacts and an arc interruption system comprising an arc chute disposed at or about said pair of separable contacts, said pair of separable contacts being structured to generate debris when tripping open in response to an electrical fault, said arc chute comprising a plurality of splitter plates each having an edge portion and at least one distal portion disposed opposite and distal said edge portion, said debris barrier comprising:

a first leg;

a second leg; and a middle portion connecting said first leg and said second leg, said middle portion being structured to be coupled to one of said pair of separable contacts, wherein at least one of said first leg and said second leg comprises a first barrier portion and a second barrier portion extending from said first barrier portion, said first barrier portion being structured to be disposed at or about said at least one distal portion, said second barrier portion being structured to extend from said first barrier portion toward said edge portion in order to redirect said debris toward said edge portion; wherein said at least one of said first leg and said second leg comprises both of said first leg and said second leg; wherein said at least one distal portion comprises a first distal portion and a second distal portion disposed opposite and distal said first distal portion; wherein said second barrier portion of said first leg and said second barrier portion of said second leg are each structured to be disposed between said first distal portion and said second distal portion; wherein said first barrier portion of said first leg comprises a first plurality of grooved regions disposed at a peripheral portion of said first leg;

and wherein said first barrier portion of said second leg comprises a second plurality of grooved regions disposed at a peripheral portion of said second leg.

7. The debris barrier of claim 6 wherein said first leg has a first end and a second end disposed opposite and distal the first end of said first leg; wherein the second end of said first leg is disposed at said middle portion; wherein said second leg has a third end and a fourth end disposed opposite and distal the third end; wherein the fourth end is disposed at said middle portion; wherein said first plurality of first grooved regions extend longitudinally from the first end of said first leg to the second end of said first leg; and wherein said second plurality of grooved regions extend longitudinally from the third end of said second leg to the fourth end of said second leg.

8. An electrical switching apparatus comprising:

a pair of separable contacts structured to generate debris when tripping open in response to an electrical fault;

an arc interruption system comprising an arc chute disposed at or about said pair of separable contacts, said arc chute comprising a plurality of splitter plates each having an edge portion and at least one distal portion disposed opposite and distal said edge portion; and a debris barrier comprising:

a first leg, a second leg, and a middle portion connecting said first leg and said second leg, said middle portion being structured to be coupled to one of said pair of separable contacts, wherein at least one of said first leg and said second leg comprises a first barrier portion and a second barrier portion extending from said first barrier portion, said first barrier portion being disposed at or about said at least one distal portion, said second barrier portion extending from said first barrier portion toward said edge portion in order to redirect said debris toward said edge portion; wherein said at least one of said first leg and said second leg comprises both of said first leg and said second leg; wherein said at least one distal portion comprises a first distal portion and a second distal portion disposed opposite and distal said first distal portion;

wherein said second barrier portion of said first leg and said second barrier portion of said second leg are each disposed between said first distal portion and said second distal portion;

wherein said second barrier portion of said first leg comprises an extension portion disposed generally perpendicular to said first barrier portion of said first leg; and wherein said second barrier portion of said second leg comprises an extension portion disposed generally perpendicular to said first barrier portion of said second leg.

9. The electrical switching apparatus of claim 8 wherein said debris barrier is a unitary component made from a single piece of thermoset material.

10. The electrical switching apparatus of claim 8 wherein said electrical switching apparatus is a multi-pole molded case circuit breaker.

11. An electrical switching apparatus comprising:

a pair of separable contacts structured to generate debris when tripping open in response to an electrical fault an arc interruption system comprising an arc chute disposed at or about said pair of separable contacts, said arc chute comprising a plurality of splitter plates each having an edge portion and at least one distal portion disposed opposite and distal said edge portion; and a debris barrier comprising:

a first leg, a second leg, and a middle portion connecting said first leg and said second leg, said middle portion being structured to be coupled to one of said pair of separable contacts, wherein at least one of said first leg and said second leg comprises a first barrier portion and a second barrier portion extending from said first barrier portion, said first barrier portion being disposed at or about said at least one distal portion, said second barrier portion extending from said first barrier portion toward said edge portion in order to redirect said debris toward said edge portion; wherein said at least one of said first leg and said second leg comprises both of said first leg and said second leg; wherein said at least one distal portion comprises a first distal portion and a second distal portion disposed opposite and distal said first distal portion;

wherein said second barrier portion of said first leg and said second barrier portion of said second leg are each disposed between said first distal portion and said second distal portion;

wherein said first leg further comprises a first pocket portion extending from said first barrier portion of said first leg away from said second barrier portion of said first leg; wherein said second leg further comprises a second pocket portion extending from said first barrier portion of said second leg away from said second barrier portion of said second leg; wherein said arc interruption system further comprises a number of U-shaped ferromagnetic laminations; and wherein said first pocket portion and said second pocket portion each receive said number of U-shaped ferromagnetic laminations.

12. The electrical switching apparatus of claim 11 wherein said second barrier portion of said first leg comprises a plurality of first grooved regions each receiving a corresponding first distal portion; and wherein said second barrier portion of said second leg comprises a plurality of second grooved regions each receiving a corresponding second distal portion.

13. The electrical switching apparatus of claim 11 wherein said first barrier portion of said first leg has a first barrier surface facing away from said first pocket portion; wherein said second barrier portion of said first leg has a second barrier surface extending at an obtuse angle from said first barrier surface away from said first pocket portion;

wherein said first barrier portion of said second leg has a third barrier surface facing away from said second pocket portion; and wherein said second barrier portion of said second leg has a fourth barrier surface extending at an obtuse angle from said third barrier surface away from said second pocket portion.

14. An electrical switching apparatus comprising:

a pair of separable contacts structured to generate debris when tripping open in response to an electrical fault;

an arc interruption system comprising an arc chute disposed at or about said pair of separable contacts, said arc chute comprising a plurality of splitter plates each having an edge portion and at least one distal portion disposed opposite and distal said edge portion; and a debris barrier comprising:

a first leg, a second leg, and a middle portion connecting said first leg and said second leg, said middle portion being structured to be coupled to one of said pair of separable contacts, wherein at least one of said first leg and said second leg comprises a first barrier portion and a second barrier portion extending from said first barrier portion, said first barrier portion being disposed at or about said at least one distal portion, said second barrier portion extending from said first barrier portion toward said edge portion in order to redirect said debris toward said edge portion; wherein said at least one of said first leg and said second leg comprises both of said first leg and said second leg; wherein said at least one distal portion comprises a first distal portion and a second distal portion disposed opposite and distal said first distal portion;

wherein said second barrier portion of said first leg and said second barrier portion of said second leg are each disposed between said first distal portion and said second distal portion;

wherein said first barrier portion of said first leg comprises a first plurality of grooved regions disposed at a peripheral portion of said first leg; and wherein said first barrier portion of said second leg comprises a second plurality of grooved regions disposed at a peripheral portion of said second leg.

15. The electrical switching apparatus of claim 14 wherein said first leg has a first end and a second end disposed opposite and distal the first end of said first leg;

wherein the second end of said first leg is disposed at said middle portion; wherein said second leg has a third end and a fourth end disposed opposite and distal the third end; wherein the fourth end is disposed at said middle portion; wherein said first plurality of first grooved regions extend longitudinally from the first end of said first leg to the second end of said first leg; and wherein said second plurality of grooved regions extend longitudinally from the third end of said second leg to the fourth end of said second leg.

16. The electrical switching apparatus of claim 14 wherein said electrical switching apparatus is devoid of U-shaped ferromagnetic laminations.

* * * * *